US006357273B1

(12) United States Patent
Nóé et al.

(10) Patent No.: US 6,357,273 B1
(45) Date of Patent: Mar. 19, 2002

(54) METHOD OF REDUCING WASTE IN THE ROLLING OF STRIP SEGMENTS INTERCONNECTED BY WELD SEAMS

(75) Inventors: Rolf Nóé , Mülheim/Ruhr; Andreas Noé , Kerken, both of (DE)

(73) Assignee: BWG Bergwerk- und Walzwerk-Maschinenbau GmbH, Duisburg (DE)

( * ) Notice: Subject to any disclaimer, the term of this patent is extended or adjusted under 35 U.S.C. 154(b) by 0 days.

(21) Appl. No.: 09/690,867

(22) Filed: Oct. 17, 2000

(30) Foreign Application Priority Data

Oct. 21, 1999 (DE) ..... 199 50 609

(51) Int. Cl.[7] ..... B21B 13/08

(52) U.S. Cl. ..... 72/234; 72/8.6; 72/11.4; 72/205; 72/227; 72/365.2

(58) Field of Search ..... 72/8.6, 11.4, 12.3, 72/205, 234, 227, 231, 250, 365.2

(56) References Cited

U.S. PATENT DOCUMENTS

| | | | | | |
|---|---|---|---|---|---|
| 3,835,681 | A | * | 9/1974 | Shumaker | 72/234 |
| 4,179,913 | A | * | 12/1979 | Martt | 72/205 |
| 4,771,621 | A | * | 9/1988 | Sato | 72/205 |
| 5,197,179 | A | * | 3/1993 | Sendzimir et al. | 29/527.4 |

FOREIGN PATENT DOCUMENTS

| | | | | |
|---|---|---|---|---|
| DE | 4201471 | * | 8/1993 | B21B/3/02 |

* cited by examiner

*Primary Examiner*—Ed Tolan
(74) *Attorney, Agent, or Firm*—Herbert Dubno

(57) ABSTRACT

A tandem strip-rolling line has a strip store between the mill so that when the upstream mill is open on the approach of a weld seam joining successive lengths, the downstream mill rolls strip stored in the strip store and conversely when the strip is halted upstream of the second mill, the strip is rolled in the first mill and fed to the strip store.

18 Claims, 6 Drawing Sheets

METHOD OF REDUCING WASTE IN THE ROLLING OF STRIP SEGMENTS INTERCONNECTED BY WELD SEAMS

FIELD OF THE INVENTION

Our present invention relates to a method of reducing waste, i.e. the length of scrap to be removed from strip in the rolling of metal strip from segments connected by means of weld seams, especially in the cold rolling of austenitic and ferritic stainless steel strip. The invention also relates to an apparatus for this purpose, namely, a tandem strip-rolling line for continuous rolling of metal strip having weld seams connecting successive lengths thereof. In this connection the invention relates as well to a method of operating a tandem strip-rolling line to reduce the scrap length which must be cut from the strip at a weld seam.

BACKGROUND OF THE INVENTION

Tandem-rolling lines can have two or more rolling stands, successively traversed by the steel strip and, of course, the weld seam connecting successive lengths of steel strip.

In such tandem strip-rolling lines, the strip is fed in a substantially direct straight line between the rolling stands or is engaged in a looping device between the stands so that the loop which is formed between the stands can compensate for the difference in length of the strip resulting from the rolling process. Such tandem lines can also be provided in line in strip-processing lines which can be of the controlling-line type, a pickling line or a cold-rolling line for stainless steel strip or the like.

The rolling lines are operated continuously, i.e. metal strip is unwound from coils and the leading end of each length unwound from a coil is welded by a transverse weld seam to the trailing end of the strip previously unwound from a coil and already formed as part of the continuous strip.

To allow weld seams to pass through the rolling stands, the latter are generally opened for such passage. This is especially the case for austenitic and ferritic metal strip. Because of the simultaneous opening of the rolling stands for passage of the weld seam, the portions of the strip immediately upstream and immediately downstream of the respective weld are usually not rolled at all or are only partly rolled and must be cut at a downstream end of the tandem rolling line from the strip. The cut out portion represents scrap. The resulting scrap length has depended in the past on the spacing between the successive stands of the tandem line and can be about 20 m per coil of the strip. This corresponds approximately to twice the spacing between the two rolling stands of the tandem line.

With conventional tandem lines, each weld seam is stopped as it approaches the first or the upstream rolling stand, the rolling stands are opened, the weld seam is moved to a location downstream of the second or downstream rolling stand and the rolling stands are then closed. The opportunity to change the mill rolls is frequently taken while the stands are open. As a consequence, the minimum scrap length is about twice the distance between the rolling stands because over this distance the strip is only engaged by the rolls of one of the two rolling stands and is only partly rolled. The roll replacement is effected depending upon the product made, even one to ten coils.

In cold rolling of stainless steel, certain tension conditions must be maintained in terms of the inlet and outlet tensions at a rolling stand to avoid slip in the stands and instability associated therewith and which can give rise to tearing of the strip. A tearing of the strip can result in severe production losses because of down time and increased percentages of scrap being produced. For measuring of the strip tension, strip-tension measuring rollers are frequently used and the metal strip is usually slipped around strip-tensioning rollers only through an angle or arc of some 5° to some 15°. Force-measuring sensors, e.g. strain gauges, measure the horizontal and/or vertical force components which are applied by the metal strip to the strip tension-measuring rollers. The strip tension measurement thus depends on the ability of the strip to form such loops by bending easily.

With metal strip of greater strip thickness, the ability to readily bend to form such loops cannot be ensured and the metal strip of higher thickness may act more or less like a bending beam. In that case, even with zero strip tension, a force will be applied to strip-tension measuring rollers and can negatively affect the strip measurement. In addition the weight of the strip itself can be superimposed upon other forces applied to the strip-measuring rollers and thus can be another factor introducing measurement errors as a function of strip thickness into tension measurement.

Since these effects and their variations cannot usually be taken into consideration in advance, errors in the strip-tension measurements can also give rise to strip tearing.

A further problem which arises in the cold rolling of stainless steel strip and especially with hot-rolled stainless steel strip is that the lengths of strip tend to vary significantly in terms of strip thickness, strip cross sectional shape (strip profile) and strip strength from coil to coil. To accommodate this, it is necessary that the rolling stand be preadjusted sufficiently well prior to the start of rolling of the particular length. With improper adjusting, the strip can be overrolled and this can lead to strip tearing.

OBJECTS OF THE INVENTION

The principal object of the present invention is to provide an improved method of operating a tandem-rolling line for strip as described at the outset whereby the scrap loss upon passage of the weld seam through the rolling stands can be significantly reduced.

It is the object of this invention to provide an improved tandem-rolling line by which the method can be practiced.

Another object of the invention is to provide a method and apparatus for the rolling of strip with reduced scrap lengths whereby precise strip-tension measurements can be maintained between the rolling stands and which enables exact preadjustment of the rolling stands in a simple and reliable manner.

SUMMARY OF THE INVENTION

These objects are attained, in accordance with the invention in a method which results in a reduction of the scrap length in the rolling of metal strip formed by weld seams between lengths of the strip and especially in the cold rolling of austenitic and ferritic stainless steel strip in a continuous tandem rolling line with at least two rolling stands. According to the invention, as the respective weld seam approaches the first rolling stand and while the weld seam is upstream thereof, the strip is stopped or displaced at a creep while the second rolling stand further rolls the metal strip ahead of that weld seam and the metal strip to be thus further rolled is delivered by a strip store between the two rolling stands. The first rolling stand is opened and the weld seam passed through it, whereupon the first rolling stand is closed. The weld seam is brought to a standstill ahead of the second rolling stand or is advanced in a creeping or crawling mode while the first rolling stand rolls the metal strip upstream of the weld seam and this rolled metal strip is taken up in the strip store. The second rolling stand is then opened and the weld seam passed through it, whereupon the second rolling stand is closed. The weld seam is cut out of the metal strip at the outlet side of the line.

More particularly, the method of operating the tandem strip rolling line can comprise the steps of:

(a) reducing a speed of the strip upstream of the first rolling stand upon an approach of one of the weld seams thereto while continuing to roll the strip at the second rolling stand at a normal rolling speed;

(b) delivering the strip at the normal rolling speed to the second rolling stand during step (a) from a store of strip in strip storage located between the first and second rolling stands;

(c) thereafter opening the first rolling stand, passing the one of the weld seams therethrough and closing the first rolling stand on the strip;

(d) rolling the strip downstream of the one of the weld seams at the normal rolling speed;

(e) while the strip downstream of the one of the weld seams is rolled in step (d) at the normal rolling speed, reducing a speed of the strip upstream of the second rolling stand upon an approach of the one of the weld seams thereto, and simultaneously storing in the strip storage a portion of the strip upstream of the one of the weld seams;

(f) thereafter opening the second rolling stand, passing the one of the weld seams therethrough and closing the second rolling stand on the strip;

(g) then rolling the strip downstream of the one of the weld seams in the second rolling stand at the normal rolling speed; and (h) repeating steps (a) through (g) for subsequent weld seams as the weld seams approach the first rolling stand.

The metal strip which is used in the invention is especially stainless steel strip with input thicknesses up to 10 mm and the method of the invention can be carried out in tandem lines with more than two rolling stands when, between each two rolling stands or between at least two of the rolling stands, a strip store is provided.

In the cadence of the opening of the mill stands or in conjunction with an opening of the mill stand, a roll change can be effected according to the invention because the band store is so dimensioned that it can be practically emptied over the interval for which the upstream or first mill stand is opened and can practically completely be filled in the interval during which the second or downstream mill stand is opened and the first mill stand is rolling the strip upstream of the weld seam and supplying that strip to the strip store.

These features result in a reduction of the creep length in a tandem-mill line while permitting the strip to run substantially continuously through the system, whereby the scrap length can be reduced practically to the width of the weld seam and the relative proportion of the scrap form can be reduced practically to zero or minimized. The tandem rolling of the weld connected strip lengths and stainless steel strip can be affected in line in continuously operating strip-processing lines.

According to a feature of the invention, the strip tension can be measured at inlet and outlet regions of the rolling stands and preferably also at inlet and outlet regions of the strip store. The metal strip between the mill stand and through the strip store arranged between them can be rerouted through an angle of $\geqq 90°$.

As a consequence the influence of the stiffness and resistance to bending of the metal strip upon the measurements which can give rise to substantial measurement errors with small looping angles, is proportionately small. It is only necessary then to take the strip weight into consideration in the measurement.

With the invention a relatively precise strip-tension measurement can be made between the mill stands and a stable rolling process is ensured.

Advantageously, the strip tension downstream of the first mill stand and upstream of the second mill stand are adjusted for this purpose. In some cases it is also advantageous to provide a strip tension downstream of the first roll stand which is not equal to the strip tension upstream of the second roll stand. Different band tensions can be a positive effect on the stability of the rolling process and can allow maximum reduction per pass.

According to another feature of the invention, before the rolling, at the leading end of the strip, at least the strip thickness and the strip strength are measured and utilized for the preadjustment of the mill stands with respect to the rolling force and the planarity of the rolls. The measurements can be effected directly or indirectly and supplied to a control circuit which can have a setpoint value input. The measurements can be used to form the setpoint value and the setpoint value can be compared, usually in a suitable control with actual values of, for example, the rolling force during the strip processing.

The strip strength can be measured by measurement of the force of a shear and/or trimming device upstream of the first rolling stand. There is, of course, a relationship between the shear force and resistance to shear and the tensile strength both with respect to transverse cutting and with respect to trimming of the strip.

The strip strength can be given by the measurement of the tensile force required for a given degree of stretch in a stretch-bend leveler provided upstream of the first rolling mill and/or by the measurement of the rolling force required for a predetermined degree of dressing of the strip in a dressing mill stand also upstream of the first rolling stand. In stretch-bend leveling, the tensile force required for a predetermined degree of stretch is a function of the elastic limit and the flow curve while the rolling force of dressing for a predetermined degree of dressing is also a function of the elastic limit and the flow curve. It is thus possible from measurements at devices upstream of the first rolling mill to determine the characteristics of the strip of a coil before its rolling commences and to form a setpoint from these measurements based upon modeling. The improved determination of setpoint values in this manner prevents overrolling and strip tearing. The result is a more effective utilization of the rolls and a higher productivity of the entire apparatus.

The invention rolls pertains to a tandem line for carrying out the invention. More particularly a tandem strip rolling roll can comprise:

an upstream first rolling stand and a downstream second rolling stand for rolling the strip;

a strip storage between the rolling stands for storing the strip; and control means for:

a) reducing a speed of the strip upstream of the first rolling stand upon an approach of one of the weld seams thereto while continuing to roll the strip at the second rolling stand at a normal rolling speed;

b) delivering the strip at the normal rolling speed to the second rolling stand during step (a) from a store of strip in a strip storage located between the first and second rolling stands;

c) thereafter opening the first rolling stand, passing the one of the weld seams there through and closing the first rolling stand on the strip;

d) rolling the strip downstream of the one of the weld seams at the normal rolling speed;

e) while the strip downstream of the one of the weld seams is rolled in step d) at the normal rolling speed, reducing a speed of the strip upstream of the second rolling stand upon an approach of the one of the weld seams thereto, and simultaneously storing in the strip storage a portion of the strip upstream of the one of the weld seams;

f) thereafter opening the second rolling stand, passing the one of the weld seams therethrough and closing the second rolling stand on the strip;

g) then rolling the strip downstream of the one of the weld seams in the second rolling stand at the normal rolling speed; and h) repeating steps a) through g) for subsequent weld seams as the weld seams approach the first rolling stand.

The strip-tension measuring devices upstream of and downstream of the roll stands and optionally between them and upstream of and downstream of the strip store can be rerouting rollers and/or tensioning rollers for the continuous metal strip and the storage loop and preferably are mounted via force-measuring devices and are looped by the strip through at least 45° and preferably at least 90°. The strip can loop up to 180° and possible more around such rollers. This eliminates measurement errors associated with measuring rollers as small looping angles.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
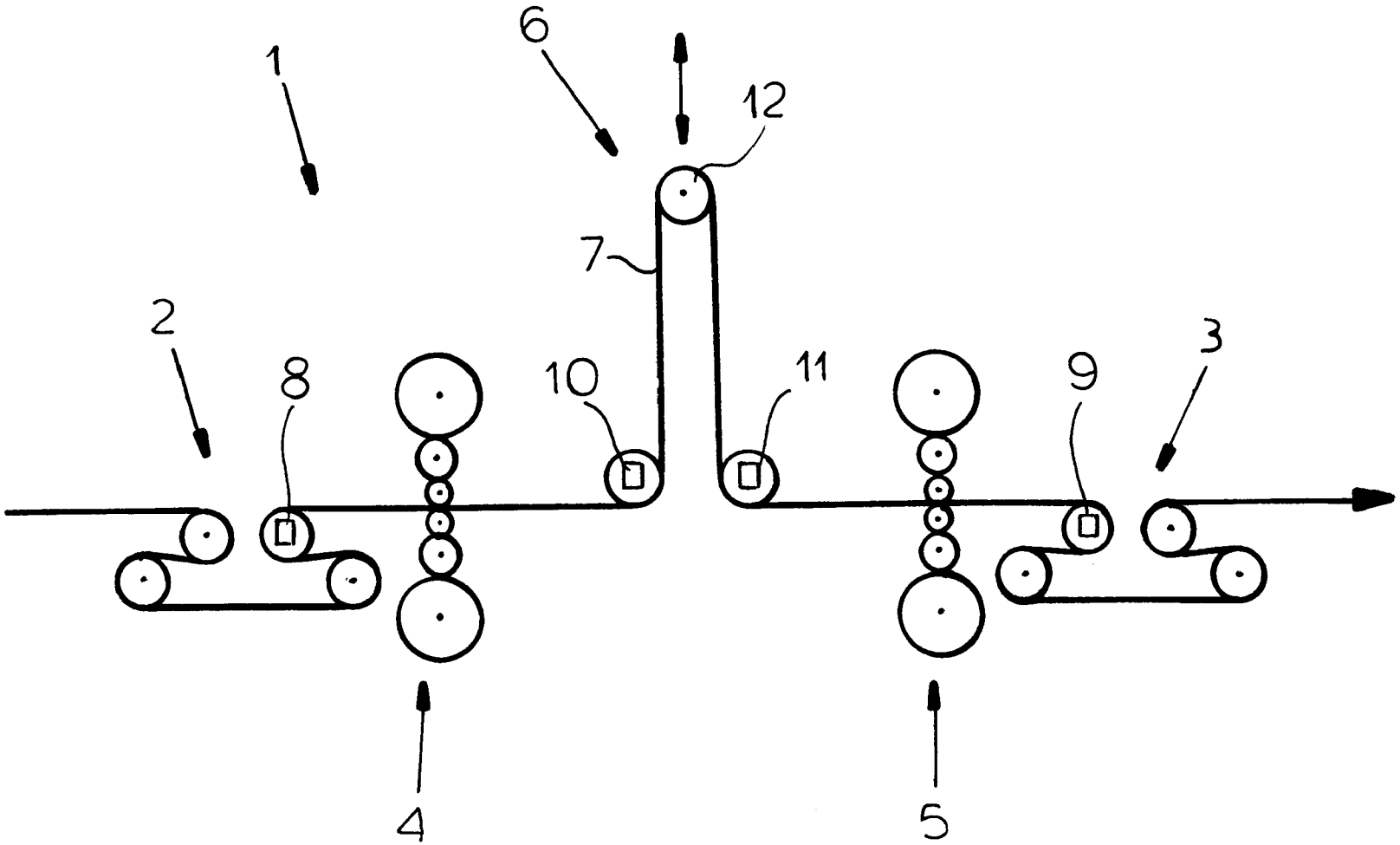
FIG. 1 is a portion of a tandem-rolling line in schematic side elevation illustrating the invention.

FIGS. 1–5, a strip processing line 1 for a continuous metal strip 7 has been shown and into which a tandem in-line rolling stretch is inserted. For the strip processing line in FIG. 1, only an inlet set of bridles 2 and an outlet set of bridles 3 have been shown. The tandem line comprises two roll stands or mills 4, 5. Between the two roll stands 4 and 5, a strip store 6 is provided. The roll stands 4 and 5 can open alternatively. Upstream and downstream of the roll stands 4, 5, strip-tension measurement devices 8 and 9 are arranged, one in the region of the inlet bridle set 2 and the other in the region of the outlet bridle set 3. In addition strip-tension measuring devices 10 and 11 are provided upstream and downstream of the strip store 6. The strip store 6 has a rerouting roller 12 between the rollers 10 and 11 and which can be driven upwardly to take up the strip 7.

Figure 2:
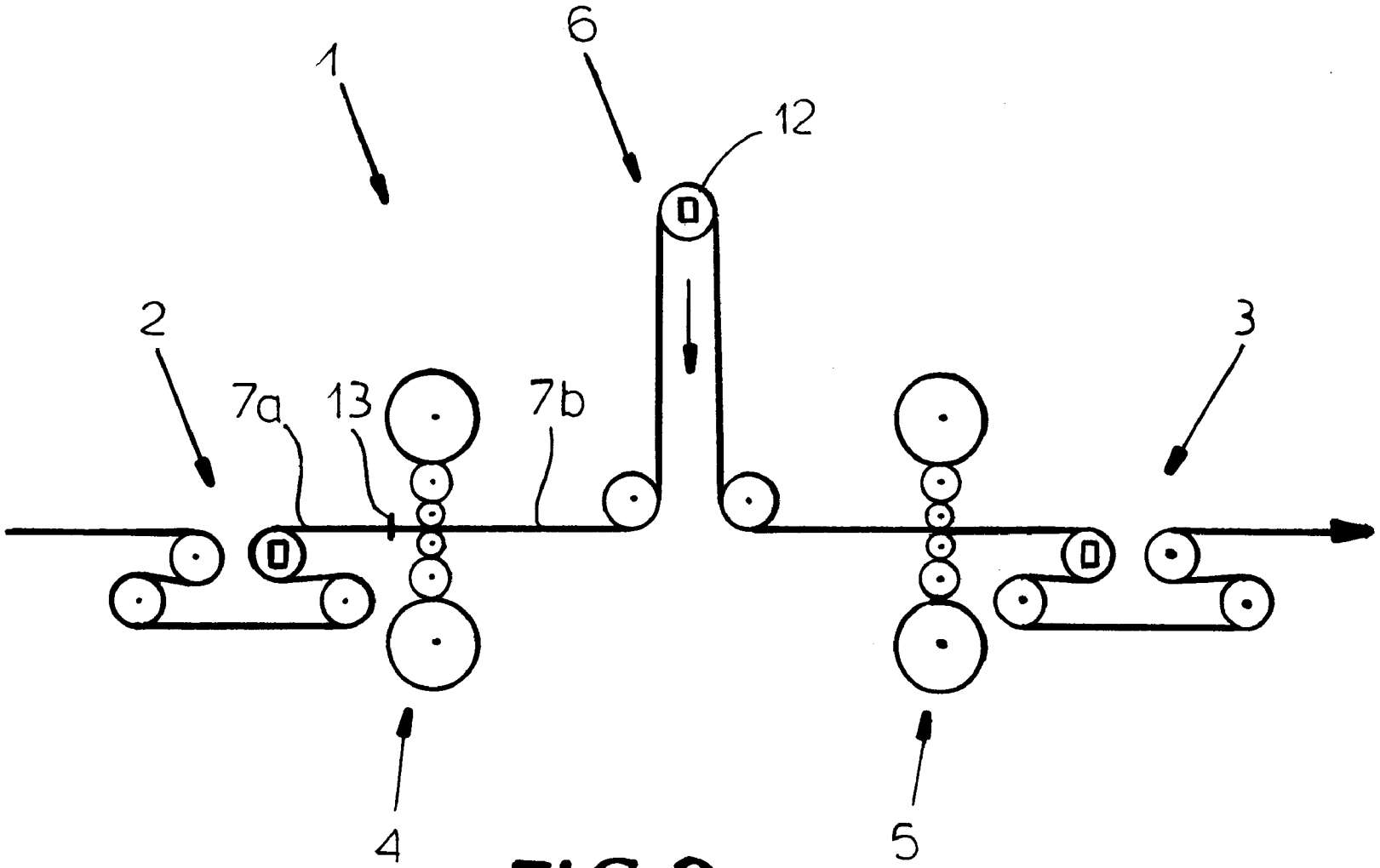
FIGS. 2–5 show successive steps in the rolling operation.
Figure 3:
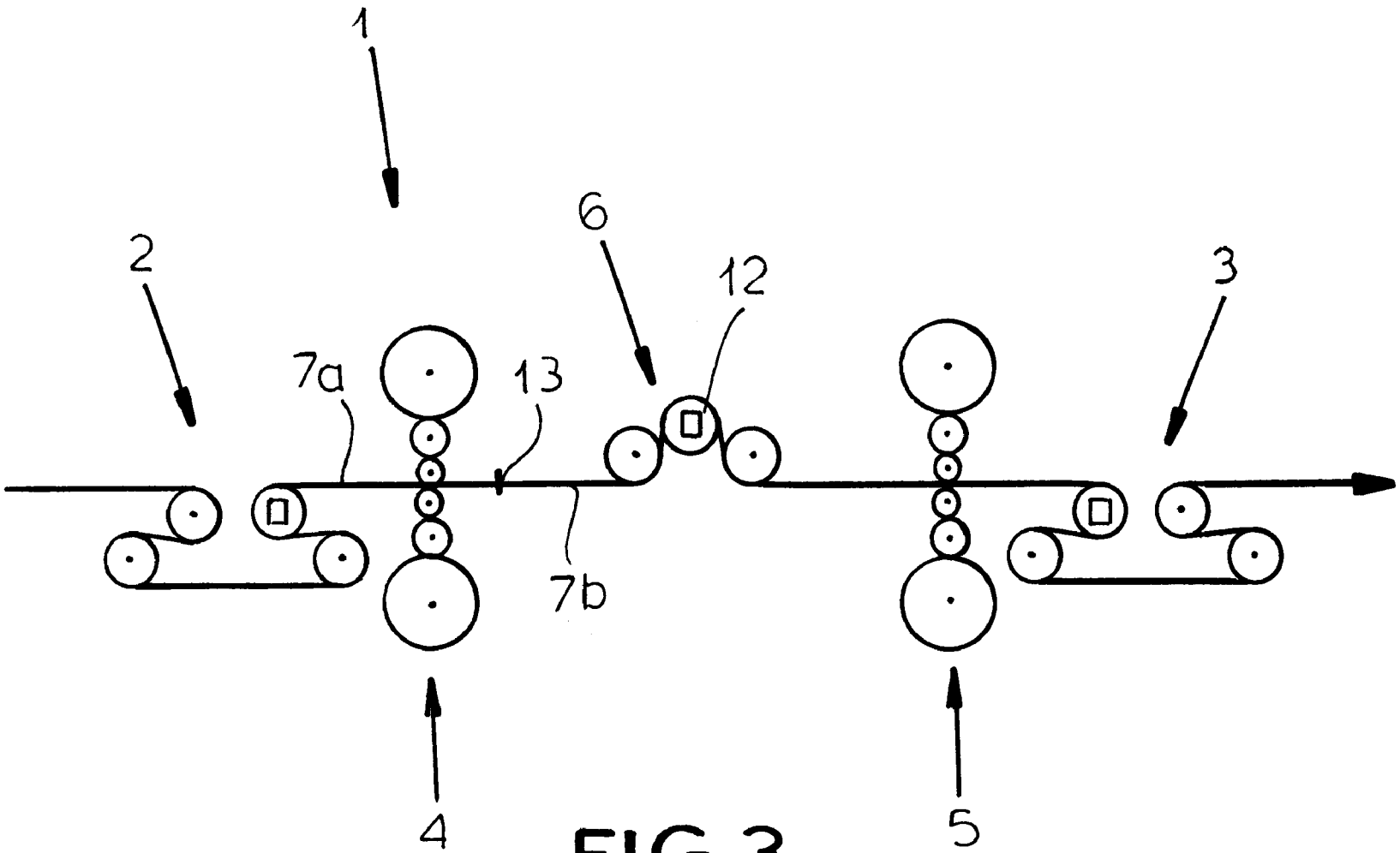

As can be seen from FIG. 2 a weld seam 13 joins two lengths 7*a* and 7*b* of metal strip. The weld seam 13 is advanced up to the first mill 4 and is then stopped while the second roll stand 5 operates at standard speed to roll the length of strip stored in the store 6. Then (FIG. 3) the first roll frame 4 is opened and can undergo roll change. The weld seam 13 passes through the open frame and the first roll frame is closed. All the while the second roll frame 5 continues to roll the strip.

Figure 4:
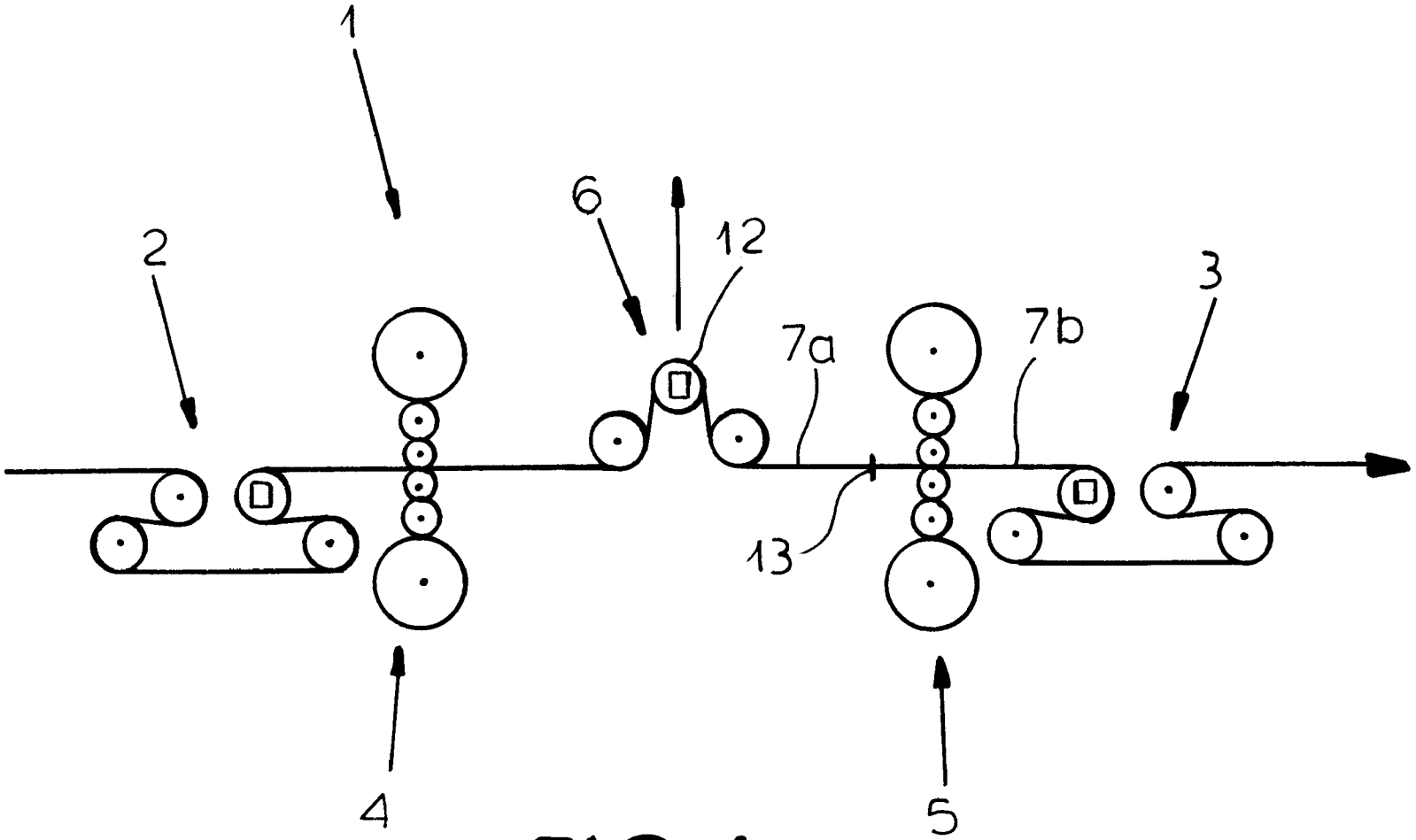
Figure 5:
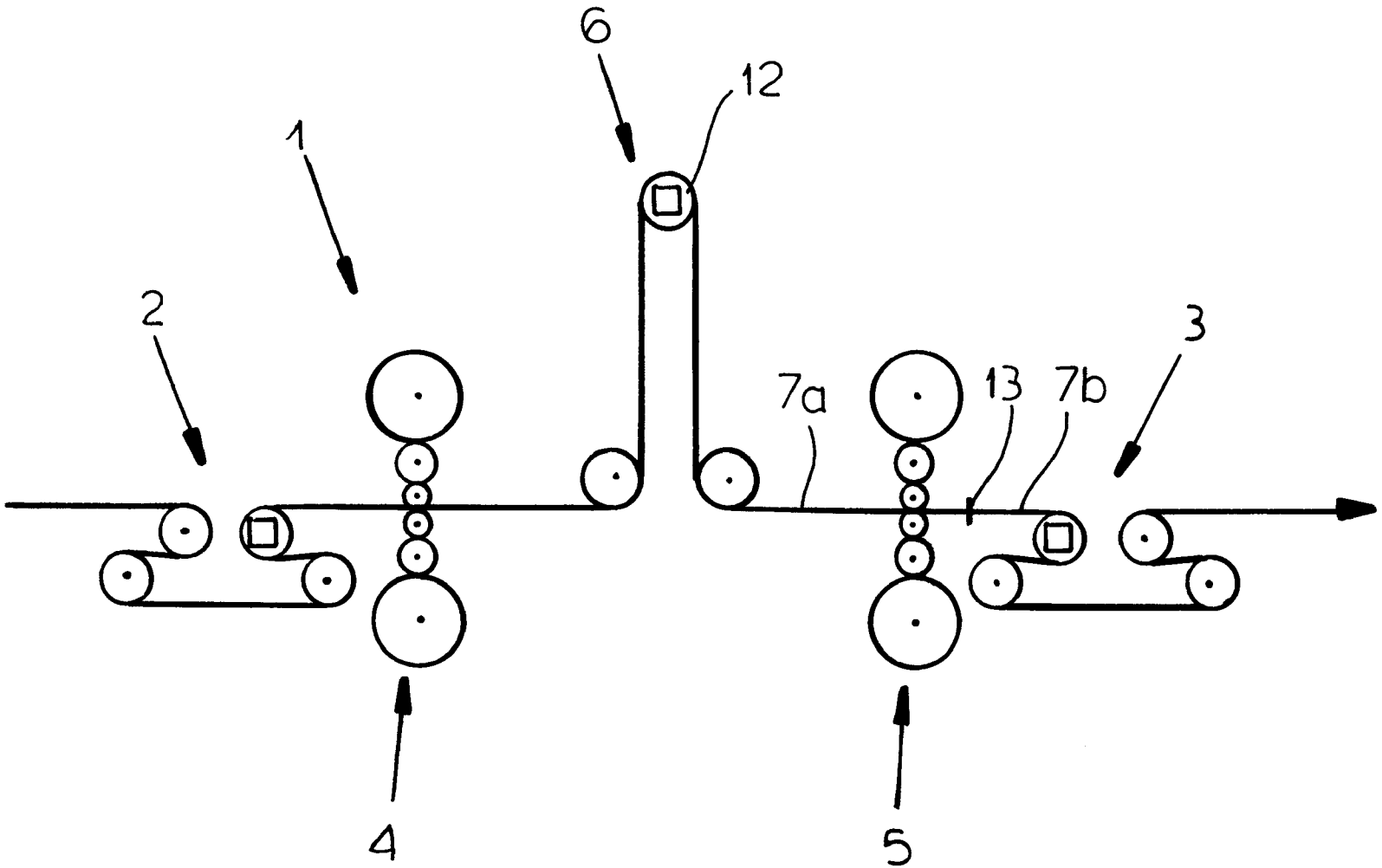

As can be seen from FIG. 4, when the weld seam 13 is proximal to the second mill stand 5, the strip is stopped while the strip upstream thereof continues to be rolled by the mill stand 4 at normal rolling speeds, the strip being taken up in the strip store 5.

When the second mill 5 is opened to pass the weld seam 13 and can undergo roll change before the mill is closed again, all while the first mill 4 continues to roll the strip and the strip is taken up in the strip store 6. The modest length of unrolled strip, corresponding to the width of the weld seam 13 can be cut off at the end of the line.

Figure 6:
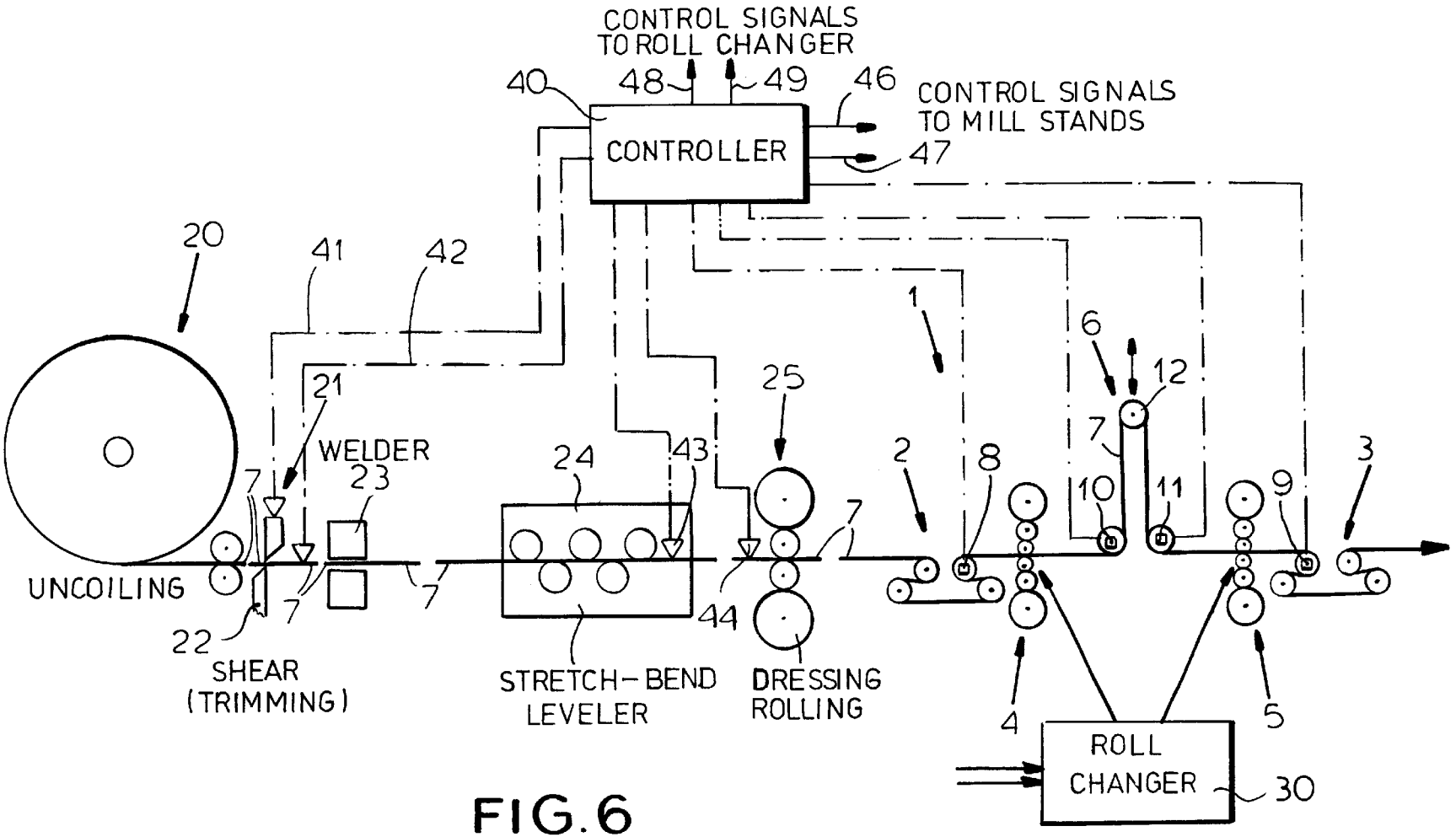
FIG. 6 is a more detailed view of the rolling line.

FIG. 6 shows that the strip can be joined by a welder 23 from lengths fed from coils 20 at an uncoiling station, the ends of the lengths being formed even by a shear 22 at a shearing and trimming station. A stretch-bend leveler 24 and a dressing roll stand 25 are provided upstream of the first bridle set 2 and a roll changer 30 serves to change the rolls in the open mills. The controller 40 can receive inputs 41 from the shearing and trimming operation at 42 from measurements of the thickness of the oncoming strip, at 43, representing the force for a given stretch at the bend leveler at 44 reflecting the force required for dressing rolling and from the tension measuring devices 8–11 previously described and provides the control signals 46 and 47 for setting and controlling the mills 4 and 5 and the control signals 48 and 49 to the roll changer 30 for operation thereof.

We claim:

1. A method of operating a tandem strip-rolling line for continuous rolling of metal strip having weld seams connecting successive lengths thereof with at least an upstream first rolling stand and a downstream second rolling stand so as to reduce the scrap length which must be cut from the strip at a weld seam, said method comprising the steps of:

(a) reducing a speed of said strip upstream of said first rolling stand upon an approach of one of said weld seams thereto while continuing to roll said strip at said second rolling stand at a normal rolling speed;

(b) delivering said strip at said normal rolling speed to said second rolling stand during step (a) from a store of strip in a strip storage located between said first and second rolling stands;

(c) thereafter opening said first rolling stand, passing said one of said weld seams therethrough and closing said first rolling stand on said strip;

(d) rolling the strip downstream of said one of said weld seams at said normal rolling speed;

(e) while the strip downstream of said one of said weld seams is rolled in step (d) at said normal rolling speed, reducing a speed of said strip upstream of said second rolling stand upon an approach of said one of said weld seams thereto, and simultaneously storing in said strip storage a portion of said strip upstream of said one of said weld seams;

(f) thereafter opening said second rolling stand, passing said one of said weld seams therethrough and closing said second rolling stand on said strip;

(g) then rolling the strip downstream of said one of said weld seams in said second rolling stand at said normal rolling speed; and (h) repeating steps (a) through (g) for subsequent weld seams as said weld seams approach said first rolling stand.

2. The method defined in claim 1 wherein said one of said weld seams is brought to standstill in step (a).

3. The method defined in claim 1 wherein said one of said weld seams is brought to standstill in step (e).

4. The method defined in claim 1 wherein said one of said weld seams is brought to a crawl in step (a).

5. The method defined in claim 1 wherein said one of said weld seams is brought to a crawl in step (e).

6. The method defined in claim 1, further comprising the step of effecting a roll change in at least one of said rolling stands in conjunction with the opening of the respective stand.

7. The method defined in claim 1 wherein the tandem rolling of the strip is effected in line in a strip process line.

8. The method defined in claim 1, further comprising the step of measuring the tension of said strip at an inlet region and an outlet region of the rolling stands.

9. The method defined in claim 1, further comprising the step of measuring the strip tension in an inlet region and an outlet region of said strip storage.

10. The method defined in claim 1, further comprising the step of adjusting the strip tension downstream of said first rolling stand and upstream of said second rolling stand.

11. The method defined in claim 1, further comprising the step of, prior to rolling, measuring at least a strip thickness and a strength of the strip at a leading end of said strip and preadjusting the rolling force and the surface effect of rolling of said rolling stands in response to the strip thickness and strip strength.

12. The method defined in claim 1 wherein the strip strength, measured by measuring force applied at a shear or trimming unit upstream of said first rolling stand.

13. The method defined in claim 1, further comprising the step of measuring the strip strength determining a tension force required for a predetermined stretch of said strip in a stretch-bend leveler or rolling the strip with a predetermined degree of thickness adjustment in a dressing roller stand located upstream of said first rolling stand.

14. A tandem strip-rolling line for continuous rolling of metal strip having weld seams connecting successive lengths thereof, comprising:

an upstream first rolling stand and a downstream second rolling stand for rolling said strip;

a strip storage between said rolling stands for storing said strip; and control means for:

a) reducing a speed of said strip upstream of said first rolling stand upon an approach of one of said weld seams thereto while continuing to roll said strip at said second rolling stand at a normal rolling speed;

b) delivering said strip at said normal rolling speed to said second rolling stand during step (a) from a store of strip in a strip storage located between said first and second rolling stands;

c) thereafter opening said first rolling stand, passing said one of said weld seams there through and closing said first rolling stand on said strip;

d) rolling the strip downstream of said one of said weld seams at said normal rolling speed;

e) while the strip downstream of said one of said weld seams is rolled in step d) at said normal rolling speed, reducing a speed of said strip upstream of said second rolling stand upon an approach of said one of said weld seams thereto, and simultaneously storing in said strip storage a portion of said strip upstream of said one of said weld seams;

f) thereafter opening said second rolling stand, passing said one of said weld seams therethrough and closing said second rolling stand on said strip;

g) then rolling the strip downstream of said one of said weld seams in said second rolling stand at said normal rolling speed; and h) repeating steps a) through g) for subsequent weld seams as said weld seams approach said first rolling stand.

15. The tandem strip-rolling line defined in claim 14, further comprising strip-tension measuring devices provided upstream of said rolling stand, downstream of said rolling stand and optionally between said rolling stands.

16. The tandem strip-rolling line defined in claim 15 wherein strip tension measuring devices are provided upstream of and downstream of said strip storage.

17. The tandem strip-rolling line defined in claim 16 wherein said tension-measuring devices include force-responsive sensors located below the bearings of rerouting and tensioning rollers for said strip and looped by at least 45° by said strip.

18. The tandem strip-rolling line defined in claim 17 wherein said rollers are looped by at least 90° by said strip.

* * * * *